US006343691B1

(12) United States Patent
Focke et al.

(10) Patent No.: US 6,343,691 B1
(45) Date of Patent: Feb. 5, 2002

(54) HINGE-LID PACK FOR CIGARETTES

(76) Inventors: Heinz Focke, Moorstr. 64, 67283 Verden; Henry Buse, Dreessel Nr.8, 27374 Visselhövede, both of (DE)

( * ) Notice: Subject to any disclaimer, the term of this patent is extended or adjusted under 35 U.S.C. 154(b) by 0 days.

(21) Appl. No.: 08/655,833

(22) Filed: May 31, 1996

(51) Int. Cl.[7] ..... B65D 85/10

(52) U.S. Cl. ..... 206/268; 206/242; 206/265; 206/273; 229/160.1

(58) Field of Search ..... 206/242, 259, 206/265, 268, 271, 273, 831; 229/160.1

(56) References Cited

U.S. PATENT DOCUMENTS

| | | | | |
|---|---|---|---|---|
| 4,466,536 A | * | 8/1984 | Zeitel | 206/268 |
| 4,729,508 A | * | 3/1988 | Erdmann et al. | 206/268 |
| 4,753,384 A | | 6/1988 | Focke et al. | |
| 4,951,862 A | * | 8/1990 | Taddia et al. | 206/273 |
| 5,129,513 A | | 7/1992 | David et al. | |
| 5,160,024 A | * | 11/1992 | Evers | 206/271 |
| 5,323,957 A | | 6/1994 | Roosa | |

FOREIGN PATENT DOCUMENTS

| | | |
|---|---|---|
| DE | 3509232 A1 | 9/1986 |
| DE | 3546446 C2 | 9/1986 |
| DE | 8607391 | 8/1987 |
| DE | 3645111 C2 | 1/1988 |
| DE | 4103612 A1 | 8/1992 |
| EP | 399250 | 11/1990 |
| GB | 2152905 | 8/1985 |

* cited by examiner

*Primary Examiner*—Paul T. Sewell
*Assistant Examiner*—Luan K. Bui

(57) ABSTRACT

Hinge-lid packs are normally comprised of a lower pack part (10) and a lid (11) which is pivotably connected thereto. The hinge-lid pack is designed such as to have a hexagonal cross-section with beveled front edges (30, 31) of the pack part (10) and the lid (11), thereby forming chamfers (34, 35).

21 Claims, 6 Drawing Sheets

Figure 1:
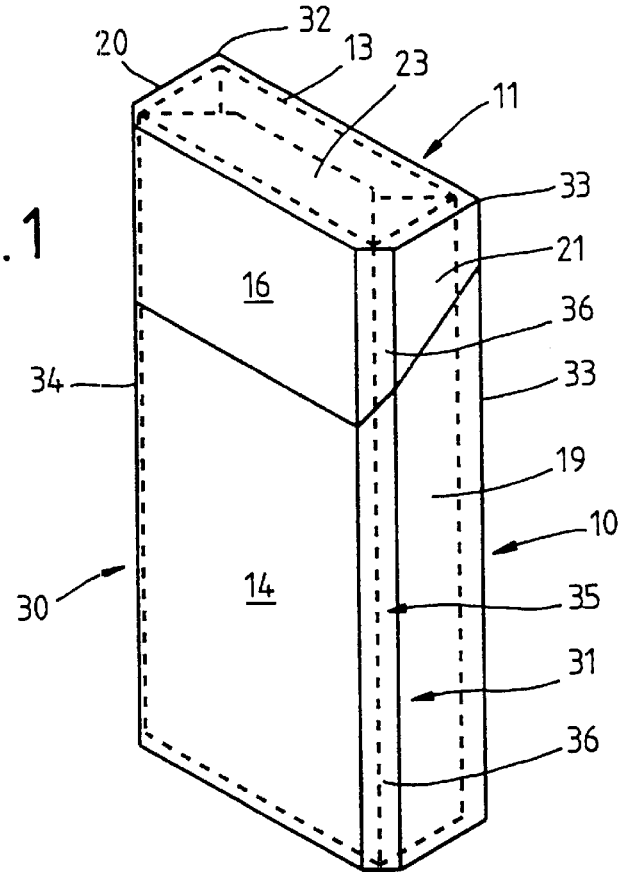

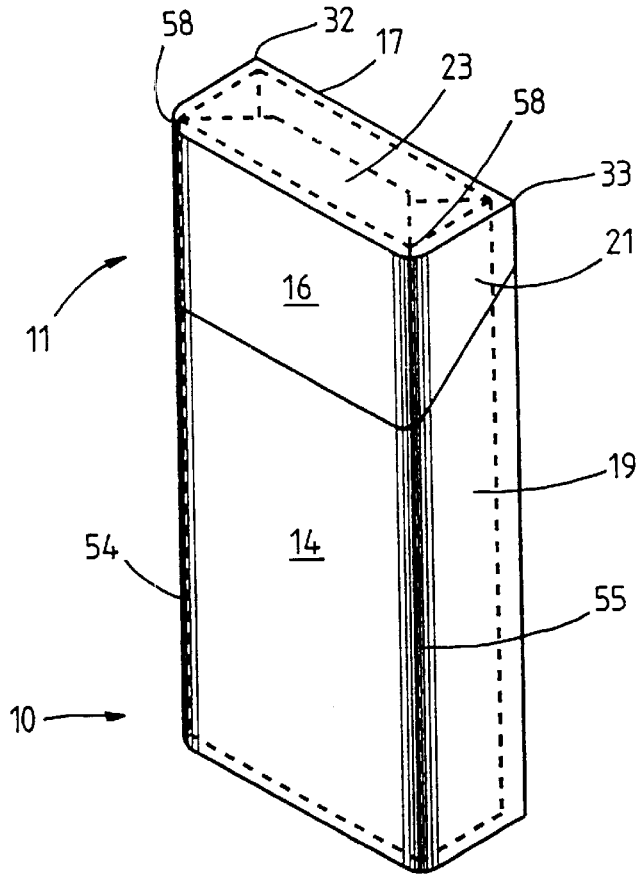
Fig.7
Fig.8
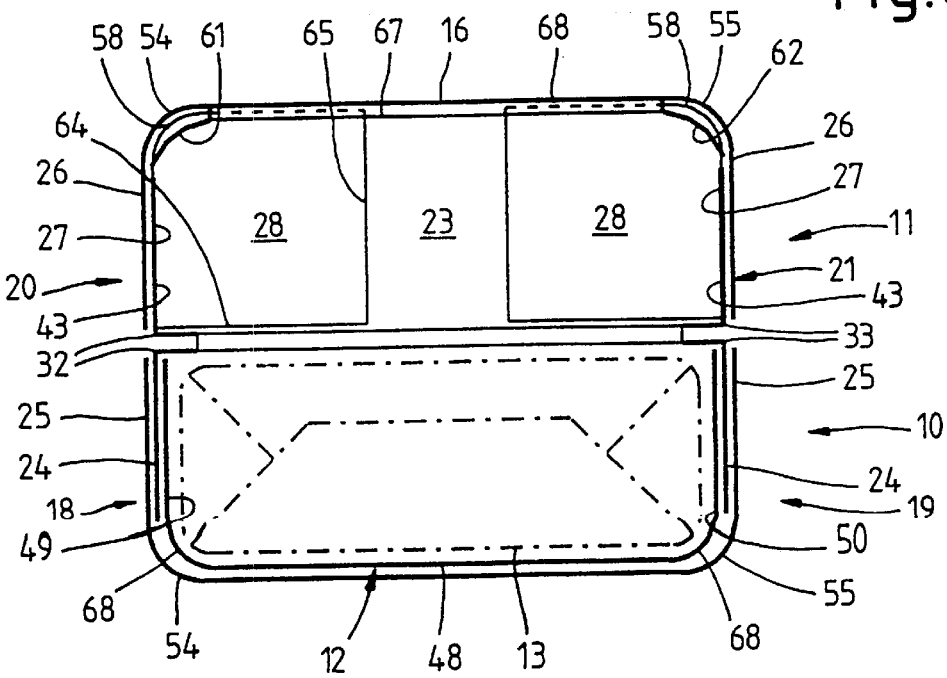

HINGE-LID PACK FOR CIGARETTES

The invention relates to a hinge-lid pack with an essentially cuboid shape made from thin cardboard or the like for receiving a cigarette group, comprised of a pack part and a lid, the lid being pivotably connected to the pack part in the region of a pack rear wall and a collar rear wall.

Hinge-lid packs made from thin cardboard belong to the standard packs for cigarettes. Pack part and lid of this pack type are formed from a one-piece blank. The collar is predominantly made from a separate blank which is also made from thin cardboard.

The invention is based on the object to develop and improve this pack type to the effect that a facilitated handling is given, on the one hand, and a material saving is possible, on the other hand, in conjunction with and improved outer appearance.

To attain this object, the hinge-lid pack according to the invention is characterized by the following features:

a) two upright longitudinal edges of the pack part and the lid, especially front edges, are designed so as to be beveled or rounded, the other two longitudinal edges, especially rear edges, have a rectangular cross-section, b) narrow, elongate side walls consist of mutually overlapping side tabs or lid side tabs, and said side tabs or lid side tabs merely overlap one another in the region outside of the beveled or rounded longitudinal edges, c) bottom corner tabs, which are connected to the side tabs in the region of a bottom wall of the pack part and/or lid corner tabs, which are connected to the lid side tabs in the region of an end wall of the lid correspond in their width or transverse dimension to the width of the bottom wall or the width of the end wall, such that the bottom corner tabs rest against the pack rear wall with margins, and the lid corner tabs rest against the lid rear wall with margins.

Consequently, the hinge-lid pack designed in this manner has differently designed cross-sections in the region of its front side, on the one hand, and its rear side, on the other. Just as in a conventional hinge-lid pack, the rear edges have a rectangular cross-section, whereas the front edges are rounded or beveled and thus form double edges. If a possibly separate collar exists, the upright edges thereof which are formed between collar front wall and collar side tabs are also beveled or rounded. In the version with beveled front edges the cross-section of the pack has a hexagonal shape.

The blank for the production of such hinge-lid packs is designed in a special manner. Upright, narrow side walls of pack part and lid consist of mutually overlapping and interconnected inner and outer side tabs and lid side tabs.

The side tabs or lid side tabs arranged on the pack rear wall and on the lid rear wall, as well as the (outer) side tabs and lid side tabs arranged on the pack front wall and on the lid front wall are designed with a smaller width than the entire width of the side walls or the hinge-lid pack itself. As a result, an overlap of the side tabs and lid side tabs is only formed in the region outside of the beveled or rounded (front) edges.

A further peculiarity of the hinge-lid pack or the blank consists in that corner tabs, which rests against the inside of an end wall of the lid or against a bottom wall of the pack part, on the other hand, in the finished hinge-lid pack have a greater width than the side tabs and lid side tabs, specifically such that these corner tabs extend over the entire width of the end wall or bottom wall within the hinge-lid pack. As a result, these corner tabs have a supporting function within the lid of the pack part.

Furthermore, the corner tabs extend immediately up to the laterally adjacent regions of the blank for the hinge-lid pack, specifically up to the end wall and bottom wall. The corner tabs are partitioned from these blank parts by means of a punch cut.

Further features of the invention relate to the design of the hinge-lid pack and, above all, to the design of the blank for hinge-lid packs with beveled or rounded front edges.

Figure 2:
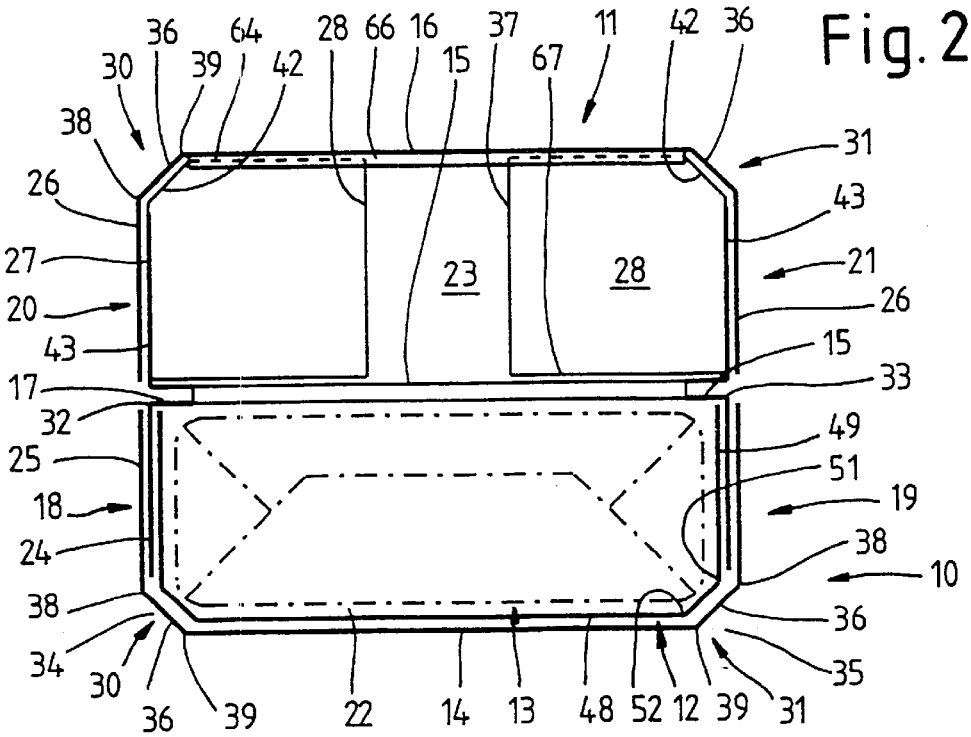
Figure 3:
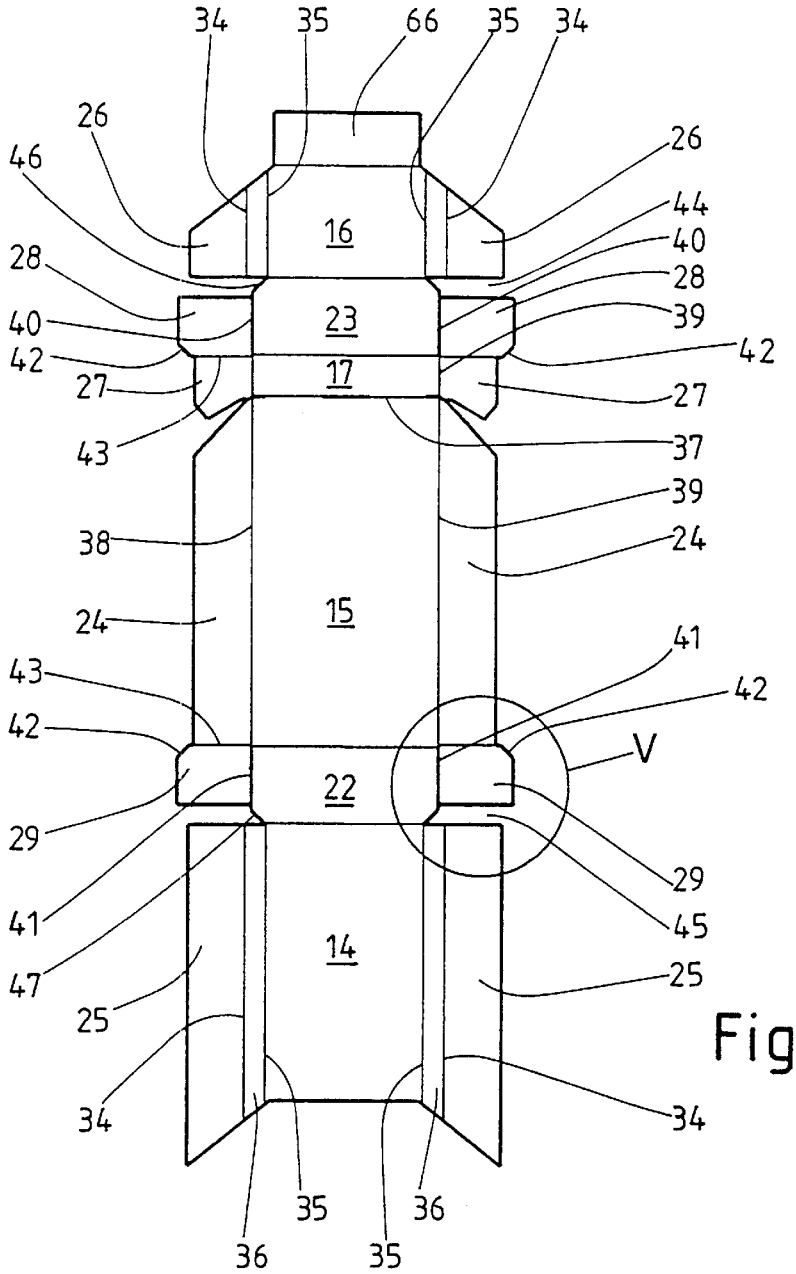
Figure 6:
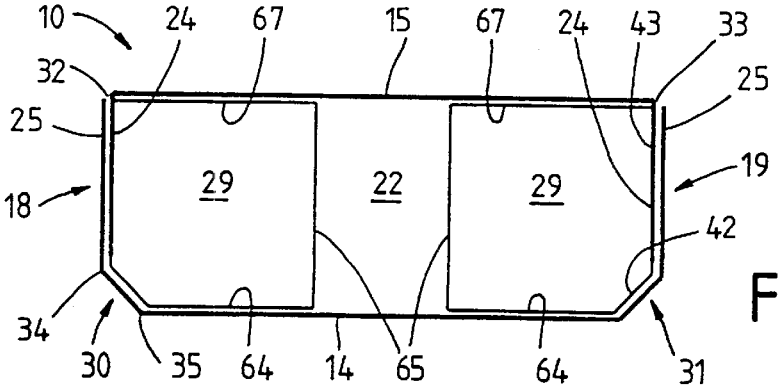
Figure 4:
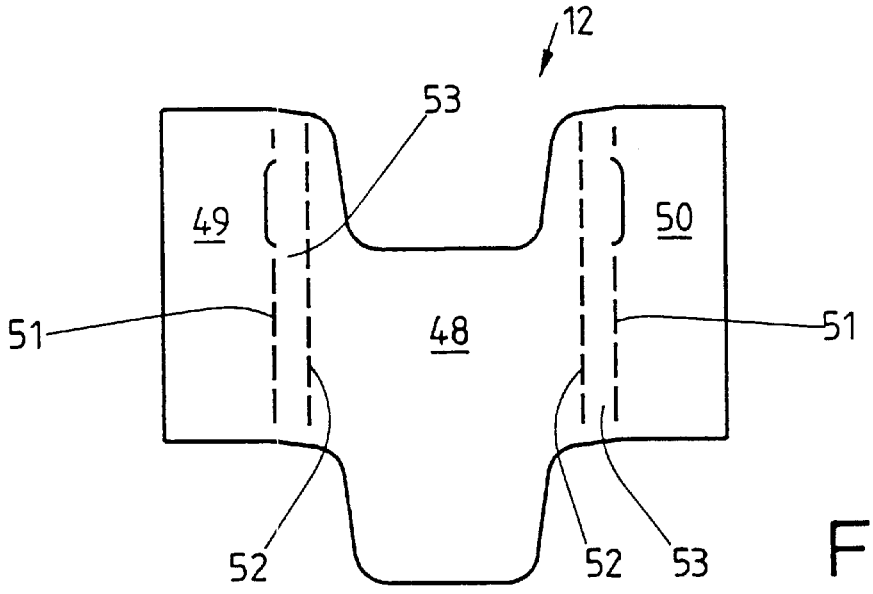
Figure 5:
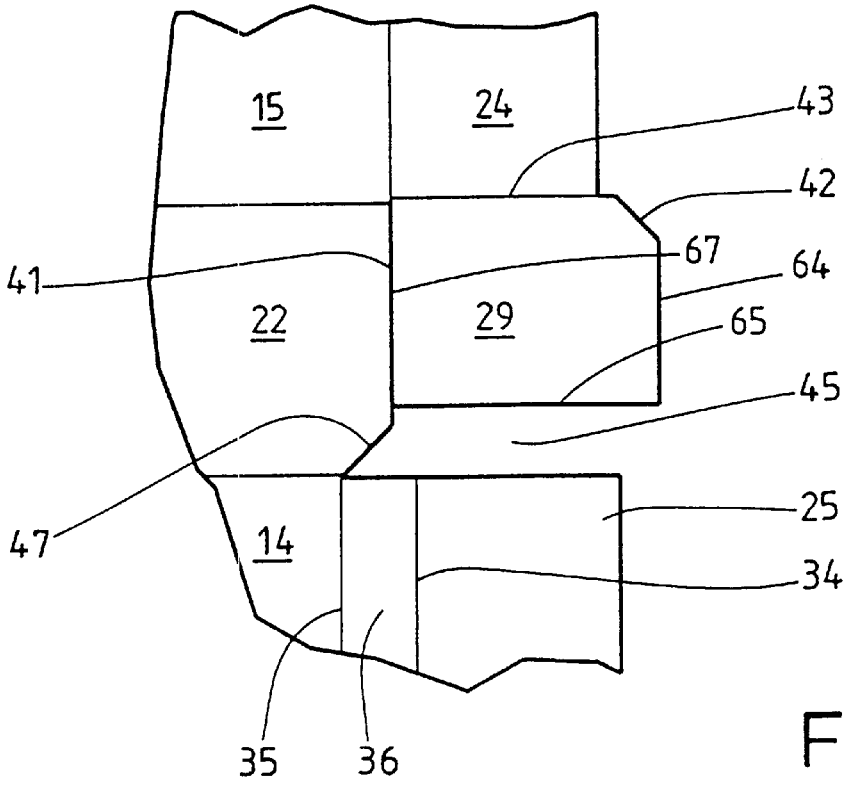
Figure 9:
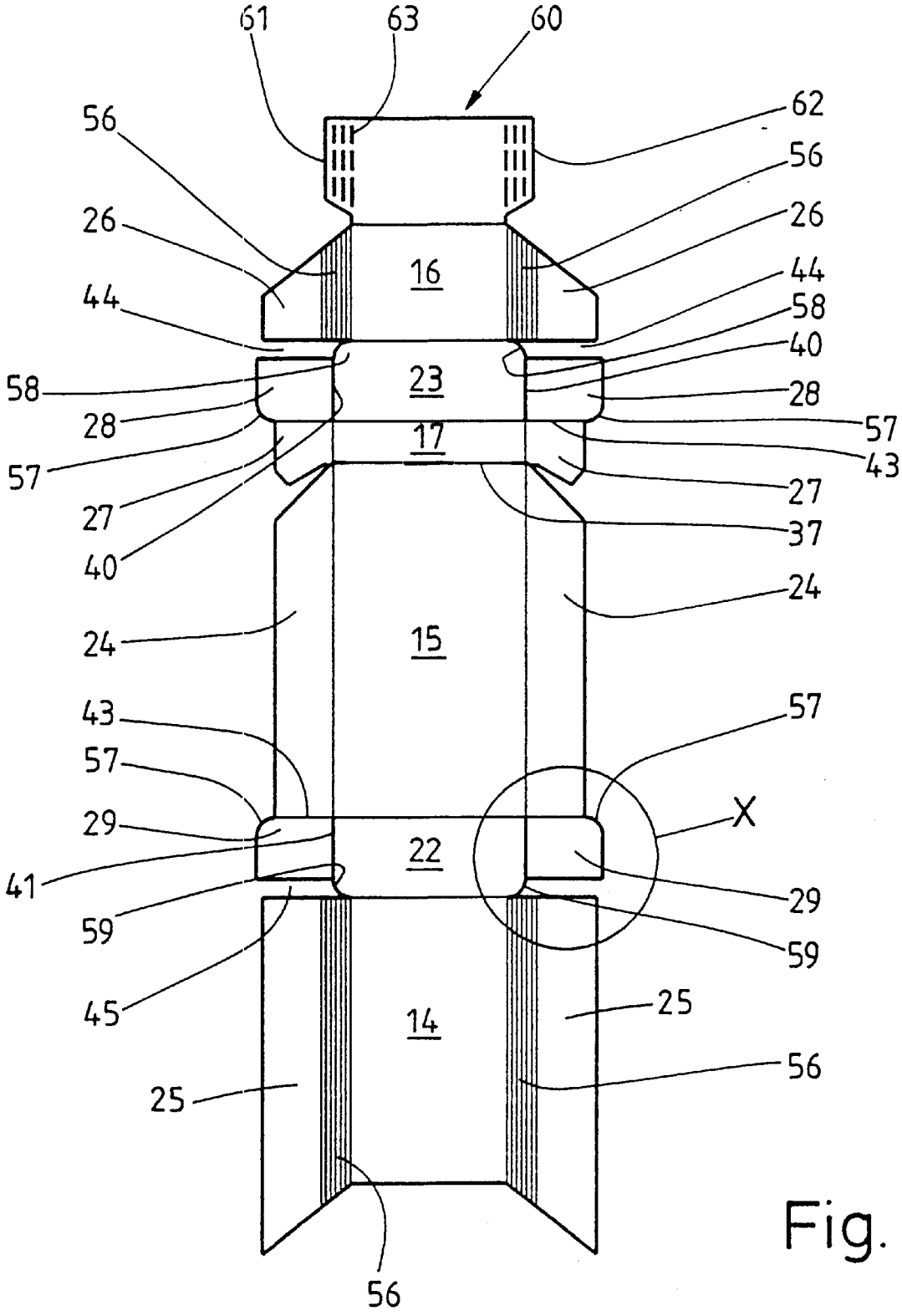
Figure 10:
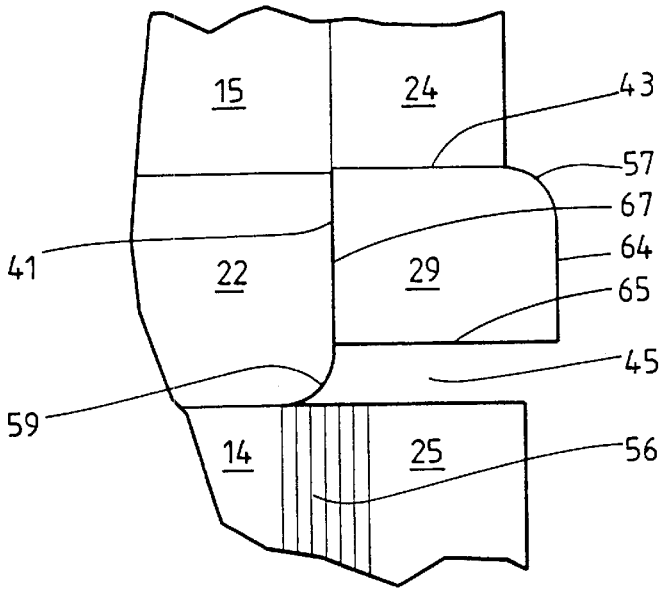
Figure 11:
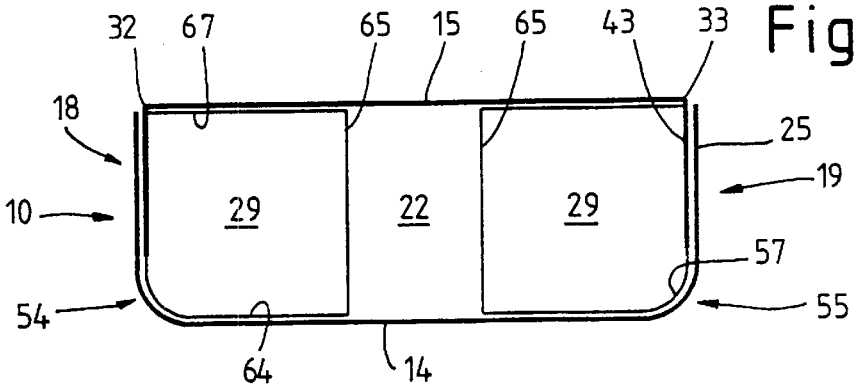
Figure 12:
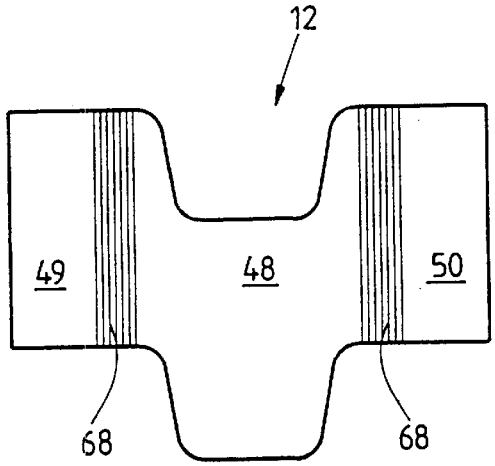

Exemplary embodiments of the packs and the blanks therefor will be explained hereinbelow with reference to the drawings. In these:

FIG. 1 shows a perspective view of a hinge-lid pack with beveled front edges, FIG. 2 shows a plan view of the hinge-lid pack according to FIG. 1 with open lid, on an enlarged scale, FIG. 3 shows a blank for a hinge-lid pack according to FIG. 1 and FIG. 2, in a spread-out position, FIG. 4 shows a separate blank for a collar, FIG. 5 shows a detail V of the blank according to FIG. 4, on an enlarged scale, FIG. 6 a plan view of the region of a bottom wall of the hinge-lid pack, FIG. 7 a perspective view of another embodiment of a hinge-lid pack, namely with rounded front edges, FIG. 8 a plan view of the hinge-lid pack according to FIG. 7 with open lid, on an enlarged scale, FIG. 9 a blank for the hinge-lid pack according to FIG. 7 and FIG. 8 in a spread out position, FIG. 10 a section X of the blank according to FIG. 9, on an enlarged scale, FIG. 11 a plan view of the region of a bottom wall of the hinge-lid pack, FIG. 12 a blank for a collar of the hinge-lid pack according to FIG. 7 and FIG. 8.

The drawings relate to hinge-lid packs for cigarettes. The base structure of this pack type consists of a (lower) pack part 10 and an (upper) lid 11. These pack parts are pivotably. connected to one another. Furthermore, a collar 12 forms a part of the pack here. Within the pack, a group of cigarettes is packed which is surrounded by an inner blank made from paper or tin foil and forms a cigarette block 13 which fills out the inner space of the pack.

The essentially cuboid hinge-lid pack consists of a pack front wall 14, a confronting pack rear wall 15, lid front wall 16, and lid rear wall 17, narrow, upright side walls, specifically pack side walls 18, 19, and lid side walls 20, 21. A bottom wall 22 belongs to the pack part 10 and—arranged oppositely—an end wall 23 to the lid 11. Pack part 10 and lid 11 are pivotably connected to one another by means. of a transversely directed articulated line 37 between pack rear wall 15 and lid rear wall 17.

The blank for such a hinge-lid pack is constructed in such a manner that the above-mentioned wall regions are limited from one another by longitudinally and transversely directed folding lines (FIG. 3 or FIG. 9). The pack side walls 18, 19 are formed by side tabs 24 and 25 which overlap one another and which are connected to one another by means of adhesive bonding or the like. Usually, the side tabs 24 which are connected to the pack rear wall 15 are located on the inside and the side tabs 25 which are connected to the pack front wall are located on the outside.

In analogy hereto, the lid side walls 20, 21 consist of lid side tabs 26 and 17. Usually outer lid side tabs 26 are connected to the lid front wall 16, and inner lid inner side tabs 27 are connected to the lid rear wall 17.

Furthermore, corner tabs are important. These are lid corner tabs 28, on the one hand, and bottom corner tabs 29, on the other. These folding tabs are connected to adjacent side tabs, specifically the lid corner tabs 28 to the inner lid side tabs 27, and the bottom corner tabs 29 to the inner side tabs 24.

Furthermore, a lid inner tab 60 or 66 belongs to the blank, which lid inner tab 60 or 61 is arranged on the free edge of the lid front wall 16 and folded against the inside thereof.

A peculiarity of the hinge-lid pack consists in that upright. longitudinal edges of the hinge-lid pack, specifically two front edges 30 and 31, on the one hand, and opposite rear edges 32, 33, on the other, have different designs. The rear edges 32, 33, which extend over the entire height of the hinge-lid pack, are designed with a rectangular cross-section.

The front edges 30, 31 have a deviating design. In the embodiment of FIGS. 1 to 6 these front edges 30, 31 are beveled, whereas in the example according to FIGS. 7 to 11, front edges 30, 31 are formed which are rounded and, therefore, have a cross-section with the shape of a graduated circle. These specially designed front edges also extend over the entire height of the hinge-lid pack.

In the first-mentioned exemplary embodiment, a hexagonal cross-section is formed as a result of the design of the pack with two additional chamfers 34, 35 and a material strip 36 arranged between the former. The material strip 36 is preferably directed at an angle of 45°. The width is adjusted to suit the diameter of the cigarettes so that the pack is adapted to the contour of the cigarettes here. The design of the front edges 30, 31 also applies to the collar 12.

The design of the hinge-lid pack results from a special blank (FIG. 3, FIG. 5; FIG. 9, FIG. 10). In the region of the pack front wall 14 and the lid front wall 15 the assigned side tabs 25 or lid side tabs 26 are delimited from said blank regions by two parallel folding lines for forming the chamfers 34, 35 (FIG. 3, FIG. 5). The pack rear wall 15 and the lid rear wall 17 are delimited from the adjacent side tabs 24 or lid side tabs 27 by longitudinal folding lines 38, 39. These folding lines—seen in the longitudinal direction of the blank—extend in a plane between the folding lines for the chamfers 34, 35. As a result, the pack rear wall 15 and lid rear wall 17 have a slightly greater width than pack front wall and lid front wall.

The width of the side tabs 24 to 27 is chosen in a special manner, namely so as to be significantly smaller than the total width or depth of the hinge-lid pack. As a result of these geometric proportions it is ensured that the side tabs 24, 25 and lid side tabs 26, 27 merely overlap one another outside of the region of the front edges 30, 31. The outer side tabs 25 and lid side tabs 26 extend on the rear side of the hinge-lid pack up to approximately the rear edge 32, 33. The inner side tabs 24 or lid side tabs 27 end in front of the confronting chamfer 34 (FIG. 2).

A further peculiarity relates to the positioning and design of the corner tabs 28, 29. In the transverse direction of the elongate blank (FIG. 4, FIG. 9) the lid corner tabs 28 and bottom corner tabs 29 project from the contour of the blank. The result is a dimension of the corner tabs 28, 29 in this direction which corresponds to the width or depth of the inner space of the hinge-lid pack. The lid corner tabs 28 are connected to the adjacent lid side tabs 27 but, however, merely partitioned from the equally adjacent end wall 23 without gaps by a punch cut 40. Likewise, the bottom corner tabs 29 are connected to the adjacent inner side tabs 24, but correspondingly delimited from the adjacent bottom wall 22 by a punch cut 41.

A corner of the corner tabs 28, 29 which is facing the lid side tab 27 or the side tab 24 is designed as an oblique corner 42. In the finished hinge-lid pack the respective oblique corner 42 properly butts against the material strip 36 in the region of the lid 11 or the pack part 10.

Regarding the lid corner tab 28, the position of the corner tabs 28, 29 designed in this manner follows especially from FIG. 2. The lid corner tab 28 properly sits in a lateral region of the lid 11 so as to adjoin an outer edge 64 on the lid front wall 16 and a punched edge 67 on the lid rear wall 17. A folding edge 43 is formed laterally because of the connection with the lid side tab 27.

The region of the bottom wall 22 is designed in analogy to the end wall 23. The bottom corner tabs 29 are folded along the folding edge 43 into a transverse position relative to the side tab 24 and rest properly and positively on the end regions of the bottom wall 22. An outer edge 64 of the bottom corner tab 29 rests against the pack front wall 14. A transverse edge 65 extends over the entire width of the bottom wall 22. Opposite of the outer edge 64, a punched edge 67 of the bottom corner tab 29 rests against the pack rear wall 15. As a result of this design of the corner tabs 28 and 29, the hinge-lid pack obtains an additional transverse reinforcement in the region of the bottom wall 22 and the end wall 23.

Between the corner tabs 28, 29, on the one hand, and the respectively outer side tabs 25 or lid side tabs 26, a punched cutout 44, 45 is formed. In this region, the end wall 23 or the bottom wall 22 are exposed and form a bevel 46, 47. As a result, end wall 23 and bottom wall 22 obtain a contour which corresponds to the cross-sectional shape of the hinge-lid pack. The exposed bevels 46, 47 properly butt against upright walls of the hinge-lid pack, specifically against the material strips 36 in the region of the lid 11 and the pack part 10.

The collar 12 (FIG. 4) is adapted to the shape of the pack. A collar front wall 48 is separated from adjacent collar side tabs 49, 50 by two parallel folding lines 51, 52. These folding lines may be marked by embossing or—as in FIG. 4—by punch cuts. A material strip 53 is formed between the folding lines 51, 52, in analogy to the material strip 36.

The collar 12 designed in this way sits in the upper region of the pack part 10 in the usual manner and is connected to the inner side of the pack front wall 14 and the pack side tabs 18, 19. An upper part region of the collar 12 projects from the pack part 10. The collar 12 is also provided with beveled edges between collar front wall 48 and collar side tabs 49, 50, corresponding to the design of the hinge-Lid pack. The collar side tabs 49, 50 extend up to the pack rear wall 17 (FIG. 2).

FIGS. 7 to 11 show details of a hinge-lid pack which is designed in analogy to the described exemplary embodiment but with front edges 30, 31 in the embodiment as round edges 54, 55. The cross-section of these round edges 54, 55 approximately corresponds to a quadrant, specifically with the dimensions adapted to the diameter of a cigarette. As a result, the cigarette block 13 can be positively received in the front region of the hinge-lid pack.

The blank (FIG. 9, FIG. 10) is designed in analogy to the described exemplary embodiment according to FIGS. 3 and 6. The round edges 54, 55 are defined by an embossed strip 56, which is comprised of a number or parallel longitudinal grooves. This applies to the region between pack front wall 14, on the one hand, and the side tabs 25, on the other, and to the region between the lid front wall 16 and the lid side tabs 26.

The dimensions of the side tabs 24 to 27 correspond to those shown in FIG. 4. On the front side of the hinge-lid pack the inner side tabs 24 extend up to the embossed strips 56 without overlapping the latter. The outer side tabs 24 reach up to the rectangular rear edges 32, 33.

The region of the end wall 23 (FIG. 8) and the bottom wall 22 (FIG. 11) is designed in analogy to FIG. 2 and FIG. 6. The oblique corners are replaced by a round corner 57 which corresponds to the cross-sectional contour of the round edges 54, 55. In the folding position, the corner tabs 28 and 29 respectively extend over the entire width of the end wall 23 or bottom wall 22. End wall 23 and bottom wall 22 are designed with curvatures 58, 59 on the corners facing towards the pack front side. These curvatures 58, 59 positively rest against the upright round edges 54, 55 of the pack part 10 and the lid 11.

The lid inner tab 60 is designed in a deviating manner here. This lid inner tab 60 is broader in the transverse direction than the corresponding dimension of the of the lid front wall 16. Laterally projecting wings 61, 62 are provided with embossings or punchings 63 in the longitudinal direction. In the finished hinge-lid pack (FIG. 8) these wings 61, 62 rest in the region of the round edges 54, 55 on the inner side of the lid as a support. The collar 12 for the hinge-lid pack with round edges 54, 55 is designed in analogy to the collar 12 of FIG. 5. Between the collar front wall 48, on the one hand, and collar side tabs 49, 50, on the other, an embossed strip is formed which corresponds to the embossed strips 68, for forming collar round edges which rest against inner sides of the round edges 54, 55.

What is claimed is:

1. A hinge-lid pack with a cuboid shape made from thin cardboard for receiving a cigarette group, the pack being comprised of a pack part (10) and a lid (11), the lid (11) being pivotally connected to the pack part (10) in the region of a pack rear wall (15) and a lid rear wall (17), characterized by the following features:

a) two upright front edges (30,31) of the pack part (10) and the lid (11) are designed so as to be beveled, whereas the upright rear edges (32,33) of the pack part (10) and the lid (11) have a rectangular cross-section;

b) narrow, elongate side walls (18,19,20,21) are comprised of mutually overlapping side tabs (24,25) and lid side tabs (26,27), with the side tabs and lid side tabs merely overlapping one another in the region outside of the beveled longitudinal edges (30,31);

c) a collar (12) within the pack part (10) and projecting therefrom includes chamfers between a collar front wall (48) and collar side tabs (49,50);

d) bottom corner tabs (29) which are connected to the side tabs (24,25) in the region of a bottom wall (22) of the pack part (10) dimensionally correspond to the width of the bottom wall (22), such that the bottom corner tabs (29), with an outer edge (64), rest against the pack front wall (14) and, with an opposite edge (67), against the pack rear wall (15);

e) in the region of corners confronting the beveled longitudinal edges, the bottom corner tabs (29) are provided with an oblique corner (42) such that the bottom corner tabs (29) properly rest in the region of the chamfers (34,35) and, on the opposite side, properly rest against rear edges (32,33) with a rectangular cross-section.

2. The hinge-lid pack as claimed in claim 1, characterized in that lid corner tabs (28) which are connected to the lid side tabs (26,27) in the region of an end wall (23) of the lid, dimensionally correspond to the width of the end wall (23), such that the lid corner tabs (28), with an outer edge (64), rest against the lid front wall (16) and with edges (67), rest against the lid rear wall (17).

3. The hinge-lid pack as claimed in claim 2, characterized in that the lid corner tabs (28) in the region of the corners which face towards the beveled longitudinal edges, are provided with an oblique corner (42), such that the lid corner tabs (28) properly rest in the region of chamfers (34,35) and, on the opposite side, properly rest against rear edges (32,33) with a rectangular cross-section.

4. The hinge-lid pack as claimed in claim 2, wherein the bottom corner tabs (29) and the lid corner tabs (28) in the region of the corner which face towards the beveled longitudinal edges, are provided with an oblique corner (42), such that the corner tabs (28,29) properly rest in the region of chamfers (34,35) and, on the opposite side, rest properly against edges with a rectangular cross-section.

5. A blank made from thin cardboard for the production of hinge-lid packs with beveled front edges (30,31) and rectangular rear edges (32,33), the blank being provided with regions for forming folding tabs and walls for a pack part (10) and a lid (11), which are delimited from one another by folding lines (38,39) specifically, in succession, pack front wall (14), bottom wall (22), pack rear wall (15), lid rear wall (17), end wall (23), lid rear wall (16), and side tabs (24,25) and lid side tabs (26,27) which laterally adjoin said regions for forming pack side walls (18,19) and lid side walls (20,21), characterized by the following features:

a) between the outer side and lid tabs (25,26), and the pack front wall (14) and lid front wall (16), there is a material strip (36), which is delimited by folding lines (34,35), for the formation of beveled front edges (30, 31);

b) pack front wall (14) and lid rear wall (16) are designed with a smaller width between the inner folding lines (35) than pack rear wall (15) and lid rear wall (17);

c) the side tabs (24, 25) and lid side tabs (26,27) are designed with a smaller width than the depth of the hinge-lid pack—distance between the front wall (14) and the rear wall (15)—such that side tabs (24 to 27) which are assigned to one another can merely overlap one another in a region outside the beveled front edges (30,31);

d) bottom corner tabs (29), which are connected to the side tabs (24,25) have a width—in the transverse direction of the blank—which corresponds to the width of the bottom wall (22)—distance between the front wall (14) and rear wall (15);

e) the bottom corner tabs (29), on their outer side, are each provided with an oblique edge (42) which corresponds to the bevel (47) of the bottom wall (22), such that the bottom corner tabs (29) properly rest against the bevels (47) with the oblique edges (42).

6. The blank as claimed in claim 5, characterized in that lid corner tabs (28) which are connected to the lid side tabs (27) have a width—in the transverse direction of the blank—that corresponds to the width of the end wall.

7. The blank as claimed in claim 5, wherein the bottom corner tabs (29) which are connected to the side tabs (24) and the lid corner tabs (28) which are connected to the lid side tabs (27) laterally abut and rest against their respective bottom wall (22) or end wall (23) and are merely separated from one another by a punch cut (41 or 40).

8. The blank as claimed in claim 7, wherein between both a) the lid corner tabs (28), and the outer lid side tabs (26), and b) the bottom corner tabs (29), and the outer side tabs (25), one punch cut (44,45) each is formed, such that the bevels (46,47) of the end and bottom walls are exposed.

9. The blank as claimed in claim 6, where bottom corner tabs (29) which are connected to the side tabs (24) and lid corner tabs (28) which are connected to the lid side tabs (27) laterally abut and rest against their respective bottom wall (22) or end wall (23) and are merely separated from one another by a punch cut (41 or 40).

10. The blank as claimed in claim 9, wherein between both a) the lid corner tabs (28), and the outer lid side tabs (26), and b) the bottom corner tabs (29), and the outer side tabs (25), one punch cut (44,45) each is formed, such that bevels (46,47) of the end and bottom walls are exposed.

11. A hinge-lid pack with a cuboid shape made from thin cardboard for receiving a cigarette group, the pack being comprised of a pack part (10) and a lid (11), the lid (11) being pivotally connected to the pack part (10) in the region of a pack rear wall (15) and a lid rear wall (17), characterized by the following features:

a) two upright front edges (30,31) of the pack part (10) and the lid (11) are designed so as to be rounded, whereas the upright rear edges (32,33) of the pack part (10) and the lid (11) have a rectangular cross-section;

b) narrow, elongate side walls (18,19,20,21) are comprised of mutually overlapping side tabs (24,25) and lid side tabs (26,27), with the side tabs and lid side tabs merely overlapping one another in the region outside of the rounded longitudinal edges (30,31);

c) a collar (12) within the pack part (10) projecting therefrom including round edges between a collar front wall (48), and collar side tabs (49,50);

d) bottom corner tabs (29) which are connected to the side tabs (24,25) in the region of a bottom wall (22) of the pack part (10) dimensionally correspond to the width of the bottom wall (22), such that the bottom corner tabs (29), with an outer edge (64), rest against the pack front wall (14) and, with an opposite edge (67), against the pack rear wall (15);

e) in the region of corners confronting the rounded longitudinal edges, the bottom corner tabs (29) are provided with round corner (57), such that the bottom corner tabs (29) properly rest in the region of round corners (54,55) and, on the opposite side, properly rest against rear edges (32,33) with a rectangular cross-section.

12. The hinge-lid pack as claimed in claim 11, characterized in that lid corner tabs (28) which are connected to the lid side tabs (26,27) in the region of an end wall (23) of the lid, dimensionally correspond to the width of the end wall (23), such that the lid corner tabs (28), with an outer edge (64), rest against the lid front wall (16) and with edges (67) rest against the lid rear wall (17).

13. The hinge-lid pack as claimed in claim 12, characterized in that the lid corner tabs (28) in the region of the corners which face towards rounded longitudinal edges, are provided with a round corner (57), such that the lid corner tabs (28) properly rest in the region of round corners (54,55) and, on the opposite side, properly rest against rear edges (32,33) with a rectangular cross-section.

14. The hinge-lid pack as claimed in claim 12, wherein the bottom corner tabs (29) and the lid corner tabs (28), in the region of the corners which face towards the rounded longitudinal edges, are provided with a round corner (57), such that the corner tabs (28,29) properly rest in the region of round edges (54,55) and, on the opposite side, rest properly against edges with a rectangular cross-section.

15. A blank made from thin cardboard for the production of hinge-lid packs with rounded front edges (30,31) and rectangular rear edges (32,33), the blank being provided with regions for forming folding tabs and walls for a pack part (10) and a lid (11), which are delimited from one another by folding lines (38,39) specifically, in succession, pack front wall (14), bottom wall (22), pack rear wall (15), lid rear wall (17), end wall (23), lid rear wall (16), side tabs (24,25) and lid side tabs (26,27) which laterally adjoin said regions for forming pack side walls (18,19) and lid side walls (20,21), characterized by the following features:

a) between the outer side and lid tabs (25,26), and the pack front wall (14) and lid front wall (16), there is an embossed strip (56), which is delimited by folding lines (34,35), for the formation of rounded front edges (30,31);

b) pack front wall (14) and lid rear wall (16) are designed with a smaller width between the inner folding lines (35) than pack rear wall (15) and lid rear wall (17);

c) the side tabs (24,25) and lid side tabs (26,27) are designed with a smaller width than the depth of the hinge-lid pack—distance between the front wall (14) and the rear wall (15) —such that side tabs (24 to 27) which are assigned to one another can merely overlap one another in a region outside the rounded front edges (30,31);

d) bottom corner tabs (29), which are connected to the side tabs (24,25) have a width—in the transverse direction of the blank—which corresponds to the width of the bottom wall (22) —distance between the front wall (14) and rear wall (15);

e) the bottom corner tabs (29), on their outer side, are each provided with a round edge (57) which corresponds to the curvature (59) of the bottom wall (22), such that the bottom corner tabs (29) properly rest against the curvatures (59) with the round edges (57).

16. The blank as claimed in claim 15, characterized in that lid corner tabs (28) which are connected to the lid side tabs (27) have a width—in the transverse direction of the blank—that corresponds to the width of the end wall.

17. The blank as claimed in claim 15, wherein the bottom corner tabs (29) which are connected to the side tabs (24) and the lid corner tabs (28) which are connected to the lid side tabs (27) laterally abut and rest against their respective bottom wall (22) or end wall (23) and are merely separated from one another by a punch cut (41 or 40).

18. The blank as claimed in claim 17, wherein both a) the lid corner tabs (28), and the outer lid side tabs (26), and b) the bottom corner tabs (29), and the outer side tabs (25), one punch cut (44,45) each is formed, such that curvatures (58,59) of the end wall and bottom wall are exposed.

19. The blank as claimed in claim 16, where bottom corner tabs (29) which are connected to the side tabs (24) and lid corner tabs (28) which are connected to the lid side tabs (27) laterally abut and rest against their respective bottom wall (22) or end wall (23) and are merely separated from one another by a punch cut (41 or 40).

20. The blank as claimed in claim 19, wherein between both a) the lid corner tabs (28) and the outer lid side tabs (26), and b) the outer side tabs (25), one punch cut (44,45) each is formed such that curvatures (58,59) of the end wall and the bottom walls are exposed.

21. A hinge-lid pack with a cuboid shape made from thin cardboard for receiving a cigarette group, the pack being comprised of a pack part (10) and a lid (11), the lid (11) being pivotally connected to the pack part (10) in the region of a pack rear wall (15) and a lid rear wall (17), characterized by the following features:

a) two upright front edges (30,31) of the pack part (10) and the lid (11) have a non-orthogonal juncture with the sidewalls (18,19,20,21), whereas the upright rear edges (32,33) of the pack part (10) and the lid (11) form an orthogonal juncture with the side walls (18,19,20,21);

b) narrow, elongate side walls (18,19,20,21) are comprised of mutually overlapping side tabs (24,25) and lid side tabs (26,27), with the side tabs and lid side tabs merely overlapping one another in the region outside of the longitudinal edges (30,31);

c) a collar (12) within the pack part (10) and projecting therefrom includes a portion (53) corresponding to the shape of the upright front edges (30,31) between a portion (53) corresponding to the shape of the upright edges (30,31) collar front wall (48) and collar side tabs (49,50);

d) bottom corner tabs (29) which are connected to the side tabs (24,25) in the region of a bottom wall (22) of the pack part (10) dimensionally correspond to the width of the bottom wall (22), such that the bottom corner tabs (29), with an outer edge (64), rest against the pack front wall (14) and, with an opposite edge (67), against the pack rear wall (15);

e) in the region of corners confronting the upright front longitudinal edges, the bottom corner tabs (29) are provided with a corner (42) corresponding in shape to the upright front edges such that the bottom corner tabs (29) properly rest in the region of the non-orthogonal portion of the upright front edges (34,35) and, on the opposite side, properly rest against rear edges (32,33) with a rectangular cross-section.

* * * * *

UNITED STATES PATENT AND TRADEMARK OFFICE

CERTIFICATE OF CORRECTION

PATENT NO. : 6,343,691 B1
DATED : February 5, 2002
INVENTOR(S) : Focke et al.

It is certified that error appears in the above-identified patent and that said Letters Patent is hereby corrected as shown below:

Title page,
The following omitted information should appear as follows:

-- [73] Assignee: Focke & Co. (GmbH & Co.)
Verden, Germany

[30] Foreign Application Priority Data
May 31, 1995 [DE] Fed. Rep. of Germany … 19519505.1 --

Signed and Sealed this

Tenth Day of September, 2002

*Attest:*

*Attesting Officer*

JAMES E. ROGAN
*Director of the United States Patent and Trademark Office*

US006343691C1

(12) EX PARTE REEXAMINATION CERTIFICATE (6380th)

United States Patent

Focke et al.

(10) Number: US 6,343,691 C1

(45) Certificate Issued: Aug. 19, 2008

(54) HINGE-LID PACK FOR CIGARETTES

(75) Inventors: Heinz Focke, Verden (DE); Henry Buse, Visselhövede (DE)

(73) Assignee: Focke & Co. (GmbH & Co.), Verden (DE)

Reexamination Request:
No. 90/007,702, Aug. 31, 2005

Reexamination Certificate for:

| | |
|---|---|
| Patent No.: | **6,343,691** |
| Issued: | **Feb. 5, 2002** |
| Appl. No.: | **08/655,833** |
| Filed: | **May 31, 1996** |

Certificate of Correction issued Sep. 10, 2002.

(30) Foreign Application Priority Data

May 31, 1995 (DE) ..... 195 19 505

(51) Int. Cl.
*B65D 85/10* (2006.01)

(52) U.S. Cl. ..... 206/268; 206/242; 206/265; 206/273; 229/160.1

(58) Field of Classification Search ..... 206/268, 206/271, 273
See application file for complete search history.

(56) References Cited

U.S. PATENT DOCUMENTS 4,753,383 A * 6/1988 Focke et al. ..... 229/160.1
4,753,384 A * 6/1988 Focke et al. ..... 229/160.1
5,323,957 A * 6/1994 Roosa ..... 229/110

* cited by examiner

*Primary Examiner*—Jimmy G. Foster

(57) ABSTRACT

Hinge-lid packs are normally comprised of a lower pack part (10) and a lid (11) which is pivotably connected thereto. The hinge-lid pack is designed such as to have a hexagonal cross-section with beveled front edges (30, 31) of the pack part (10) and the lid (11), thereby forming chamfers (34, 35).

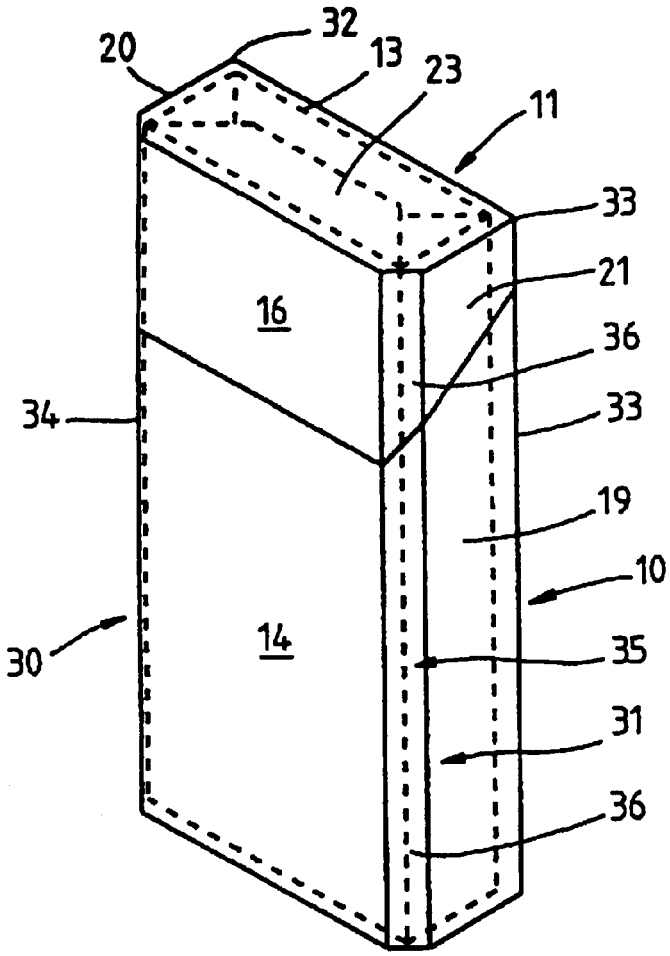

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–7, 9, 11–17, 19 and 21 are cancelled.

Claims 8, 10, 18 and 20 are determined to be patentable as amended.

8. [The blank as claimed in claim 7,] *A blank made from thin cardboard for the production of hinge-lid packs with beveled front edges (30,31) and rectangular rear edges (32, 33), the blank being provided with regions for forming folding tabs and walls for a pack part (10) and a lid (11), which are delimited from one another by folding lines (38,39) specifically, in succession, pack front wall (14), bottom wall (22), pack rear wall (15), lid rear wall (17), end wall (23), lid rear wall (16), and side tabs (24,25) and lid side tabs (26,27) which laterally adjoin said regions for forming pack side walls (18,19) and lid side walls (20,21), characterized by the following features:*

*a) between the outer side and lid tabs (25,26), and the pack front wall (14) and lid front wall (16), there is a material strip (36), which is delimited by folding lines (34,35), for the formation of beveled front edges (30, 31);*

*b) pack front wall (14) and lid front wall (16) are designed with a smaller width between the inner folding lines (35) than pack rear wall (15) and lid rear wall (17);*

*c) the side tabs (24,25) and lid side tabs (26,27) are designed with a smaller width than the depth of the hinge-lid pack—distance between the front wall (14) and the rear wall (15)—such that side tabs (24 to 27) which are assinged to one another can merely overlap one another in a region outside the beveled front edges (30,31);*

*d) bottom corner tabs (29), which are connected to the side tabs (24) have a width—in the transverse direction of the blank—which corresponds to the width of the bottom wall (22)—distance between the front wall (14) and rear wall (15);*

*e) the bottom corner tabs (29), on their outer side, are each provided with an oblique edge (42) which corresponds to the bevel (47) of the bottom wall (22), such that the bottom corner tabs (29) properly rest against the bevels (47) with the oblique edges (42);*

*wherein the bottom corner tabs (29) which are connected to the side tabs (24) and the lid corner tabs (28) which are connected to the lid side tabs (27) laterally abut and rest against their respective bottom wall (22) or end wall (23) and are merely separated from one another by a punch cut (41 or 40); and* wherein between both a) the lid corner tabs (28), and the outer lid side tabs (26), and b) the bottom corner tabs (29), and the outer side tabs (25), one punch cut (44,45) each is formed, such that the bevels (46,47) of the end and bottom walls are exposed.

10. [The blank as claimed in claim 9,] *A blank made from thin cardboard for the production of hinge-lid packs with beveled front edges (30,31) and rectangular rear edges (32, 33), the blank being provided with regions for forming folding tabs and walls for a pack part (10) and a lid (11), which are delimited from one another by folding lines (38,39) specifically, in succession, pack front wall (14), bottom wall (22), pack rear wall (15), lid rear wall (17), end wall (23), lid rear wall (16), and side tabs (24,25) and lid side tabs (26,27) which laterally adjoin said regions for forming pack side walls (18,19) and lid side walls (20,21), characterized by the following features:*

*a) between the outer side and lid tabs (25,26), and the pack front wall (14) and lid front wall (16), there is a material strip (36), which is delimited by folding lines (34,35), for the formation of beveled front edges (30, 31);*

*b) pack front wall (14) and lid front wall (16) are designed with a smaller width between the inner folding lines (35) than pack rear wall (15) and lid rear wall (17);*

*c) the side tabs (24,25) and lid side tabs (26,27) are designed with a smaller width than the depth of the hinge-lid pack—distance between the front wall (14) and the rear wall (15)—such that side tabs (24 to 27) which are assigned to one another can merely overlap one another in a region outside the beveled front edges (30,31);*

*d) bottom corner tabs (29), which are connected to the side tabs (24) have a width—in the transverse direction of the blank—which corresponds to the width of the bottom wall (22)—distance between the front wall (14) and rear wall (15);*

*e) the bottom corner tabs (29), on their outer side, are each provided with an oblique edge (42) which corresponds to the bevel (47) of the bottom wall (22), such that the bottom corner tabs (29) properly rest against the bevels (47) with the oblique edges (42);*

*wherein lid corner tabs (28) which are connected to the lid side tabs (27) have a width—in the transverse direction of the blank—that corresponds to the width of the end wall.*

*where bottom corner tabs (29) which are connected to the side tabs (24) and lid corner tabs (28) which are connected to the lid side tabs (27) laterally abut and rest against their respective bottom wall (22) or end wall (23) and are merely separated from one another by a punch cut (41 or 40); and* wherein between both a) the lid corner tabs (28), and the outer lid side tabs (26), and b) the bottom corner tabs (29), and the outer side tabs (25), one punch cut (44,45) each is formed, such that the bevels (46,47) of the end and bottom walls are exposed.

18. [The blank as claimed in claim 17,] *A blank made from thin cardboard for the production of hinge-lid packs with rounded front edges (30,31) and rectangular rear edges (32, 33), the blank being provided with regions for forming folding tabs and walls for a pack part (10) and a lid (11), which are delimited from one another by folding lines (38,39) specifically, in succession, pack front wall (14), bottom wall (22), pack rear wall (15), lid rear wall (17), end wall (23), lid rear wall (16), side tabs (24,25) and lid side tabs (26,27) which laterally adjoin said regions for forming pack side walls (18,19) and lid side walls (20,21), characterized by the following features:*

*a) between the outer side and lid tabs (25,26), and the pack front wall (14) and lid front wall (16), there is an embossed strip (56), which is delimited by folding lines (34,35), for the formation of rounded front edges (30, 31);*

*b) pack front wall (14) and lid front wall (16) are designed with a smaller width between the inner folding lines (35) than pack rear wall (15) and lid rear wall (17);*

*c) the side tabs (24,25) and lid side tabs (26,27) are designed with a smaller width than the depth of the hinge-lid pack—distance between the front wall (14) and the rear wall (15)—such that side tabs (24 to 27) which are assigned to one another can merely overlap one another in a region outside the rounded front edges (30,31);*

*d) bottom corner tabs (29), which are connected to the side tabs (24) have a width—in the transverse direction of the blank—which corresponds to the width of the bottom wall (22)—distance between the front wall (14) and rear wall (15);*

*e) the bottom corner tabs (29), on their outer side, are each provided with a round edge (57) which corresponds to the curvature (59) of the bottom wall (22), such that the bottom corner tabs (29) properly rest against the curvatures (59) with the round edges (57);*

*wherein the bottom corner tabs (29) which are connected to the side tabs (24) and the lid corner tabs (28) which are connected to the lid side tabs (27) laterally abut and rest against their respective bottom wall (22) or end wall (23) and are merely separated from one another by a punch cut (41 or 40); and* wherein both a) the lid corner tabs (28), and the outer lid side tabs (26), and b) the bottom corner tabs (29), and the outer side tabs (25), one punch cut (44,45) each is formed, such that curvatures (58,59) of the end wall and bottom wall are exposed.

20. [The blank as claimed in claim 19,] *A blank made from thin cardboard for the production of hinge-lid packs with rounded front edges (30,31) and rectangular rear edges (32, 33), the blank being provided with regions for forming folding tabs and walls for a pack part (10) and a lid (11), which are delimited from one another by folding lines (38,39) specifically, in succession, pack front wall (14), bottom wall (22), pack rear wall (15), lid rear wall (17), end wall (23), lid rear wall (16), side tabs (24,25) and lid side tabs (26,27) which laterally adjoin said regions for forming pack side walls (18,19) and lid side walls (20,21), characterized by the following features:*

*a) between the outer side and lid tabs (25,26), and the pack front wall (14) and lid front wall (16), there is an embossed strip (56), which is delimited by folding lines (34,35), for the formation of rounded front edges (30, 31);*

*b) pack front wall (14) and lid front wall (16) are designed with a smaller width between the inner folding lines (35) than pack rear wall (15) and lid rear wall (17);*

*c) the side tabs (24,25) and lid side tabs (26,27) are designed with a smaller width than the depth of the hinge-lid pack—distance between the front wall (14) and the rear wall (15)—such that side tabs (24 to 27) which are assigned to one another can merely overlap one another in a region outside the rounded front edges (30,31);*

*d) bottom corner tabs (29), which are connected to the side tabs (24) have a width—in the transverse direction of the blank—which corresponds to the width of the bottom wall (22)—distance between the front wall (14) and rear wall (15);*

*e) the bottom corner tabs (29), on their outer side, are each provided with a round edge (57) which corresponds to the curvature (59) of the bottom wall (22), such that the bottom corner tabs (29) properly rest against the curvatures (59) with the round edges (57);*

*wherein lid corner tabs 28) which are connected to the lid side tabs (27) have a width—in the transverse direction of the blank—that corresponds to the width of the end wall;*

*where bottom corner tabs (29) which are connected to the side tabs (24) and lid corner tabs (28) which are connected to the lid side tabs (27) laterally abut and rest against their respective bottom wall (22) or end wall (23) and are merely separated from one another by a punch cut (41 or 40); and* wherein between both a) the lid corner tabs (28) and the outer lid side tabs (26), and b) the outer side tabs (25), one punch cut (44,45) each is formed such that curvatures (58,59) of the end wall and the bottom walls are exposed.

* * * * *